United States Patent [19]

Koehler

[11] Patent Number: 4,698,612

[45] Date of Patent: Oct. 6, 1987

[54] TEMPERATURE LIMITING CONTROL

[75] Inventor: Randal W. Koehler, Tigard, Oreg.

[73] Assignee: Eaton Corporation, Cleveland, Ohio

[21] Appl. No.: 930,192

[22] Filed: Nov. 13, 1986

[51] Int. Cl.[4] ..... H01H 37/38

[52] U.S. Cl. ..... 337/320; 337/319; 337/313

[58] Field of Search ..... 337/313, 316, 317, 323, 337/319, 320, 321, 117, 119, 120

[56] References Cited

U.S. PATENT DOCUMENTS 3,185,796 5/1965 Mamiya ..... 337/317

4,536,736 8/1985 Aschenbach ..... 337/317

*Primary Examiner*—Harold Broome

*Attorney, Agent, or Firm*—D. A. Rowe; R. A. Johnston

[57] ABSTRACT

A thermostatic switch assembly with a diaphragm responsive to pressure generated in a fluid filled temperature sensing bulb-and-capillary. The diaphragm contacts and moves a pivoted lever having a beam spring cantilevered beam spring adjustably mounted thereon. Movement of the lower about its pivot causes the beam spring to effect actuation of a switch. Upon loss of fluid in the bulb and capillary, the diaphragm recedes and a stop remote from the lower pivot functions as an auxiliary pivot for the beam spring for effecting emergency switch actuations.

9 Claims, 5 Drawing Figures

TEMPERATURE LIMITING CONTROL

BACKGROUND OF THE INVENTION

The present invention relates to thermostatically operated switches for controlling cooling or heating equipment where the switch is actuated and deactuated in response to sensing a temperature rising and falling through predetermined levels. In particular, the present invention relates to thermostats of the type having a fluid pressure capsule which expands and contracts responsive to temperature changes, for actuating a snap-acting switch for making and breaking a set of electrical contacts in a circuit for controlling desired heating or cooling functions. Thermostats of this type usually have a sensing bulb disposed remotely from the switch mechanism and connected to the fluid pressure capsule by a capillary tube for transmitting fluid pressure to the capsule in response to temperature changes sensed by the remote fluid filled bulb.

In fluid filled bulb-and-capillary thermostats of the above described type, it has long been desired to find or way or means of providing for switch actuation in the event of loss of fluid in the bulb and capillary system resulting in total depressurization of the pressure capsule.

Typically, the pressure capsule is calibrated at room temperature to provide switch actuation upon a desired sensed rise in temperature and to deactuate when the temperature drops a desired amount from the actuation point. However, if the pressure capsule integrity is breached and fluid loss occurs, the system is rendered totally inoperative and extreme temperatures may be encountered at the bulb with no resultant change in system control. Accordingly, it has been desired to provide a way of producing switch actuation upon the pressure capsule experiencing lost fluid therein for the purpose of providing a signal input to the system being controlled indicating that a failure in the sensor mechanism has occurred.

SUMMARY OF THE INVENTION

The present invention provides a thermostatically operated switching mechanism having a snap-action electrical switch actuated by a lever pivoted about a fulcrum mounted on the housing. The lever has an auxiliary beam spring member cantilevered from one end of the lever and biased against an adjustable stop at the other end of the lever. Pivotal movement of the lever about the stationary fulcrum causes the beam spring member to contact the actuator of the snap switch and effect actuation and deactuation thereof.

The lever is moved about the stationary fulcrum by a fluid filled pressure responsive capsule which is calibrated with respect to the at-rest position of the lever. Movement of the lever by the capsule for switch actuation and deactuation at predetermined fluid pressures is generated by a capillary connected from the capsule to a bulb which is fluid filled and exposed to the temperatures to be sensed. An auxiliary adjustable stop is provided on the housing and disposed for contacting the beam spring member when the lever moves in the event of loss of liquid fill in the capsule. Movement of the lever is in a direction to cause the beam spring to now pivot about the auxiliary stop and effect actuation of the snap switch. The adjustable stop enables calibration of the swtich actuation in a simulated loss of fluid condition.

The present invention thus provides a thermostatically actuated switch assembly in which the loss of fluid in the sensing capsule causes the lever mechanism to move to a position causing pivotal movement about an auxiliary fulcrum for effecting switch actuation. The present invention thus provides an emergency signal to the system being controlled in the event of failure of the temperature sensing mechanism.

DETAILED DESCRIPTION

Figure 1:
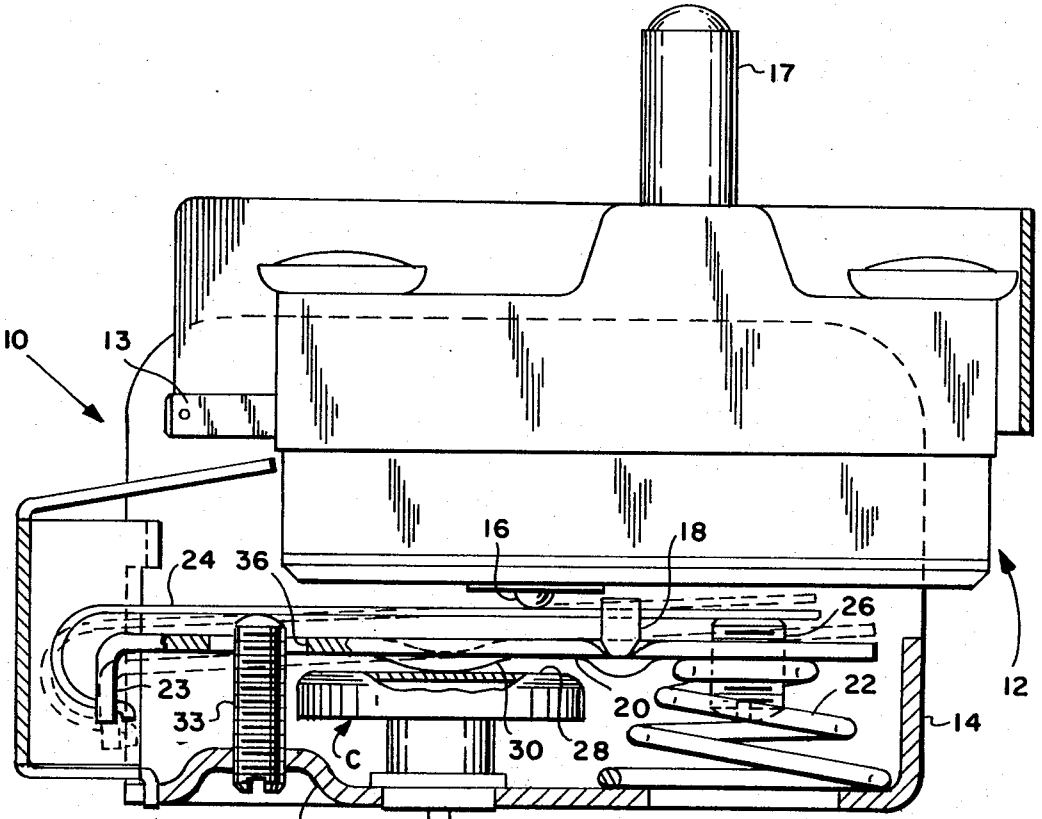
FIG. 1 is a side view in elevation of the switch mechanism of the present invention.
Figure 2:
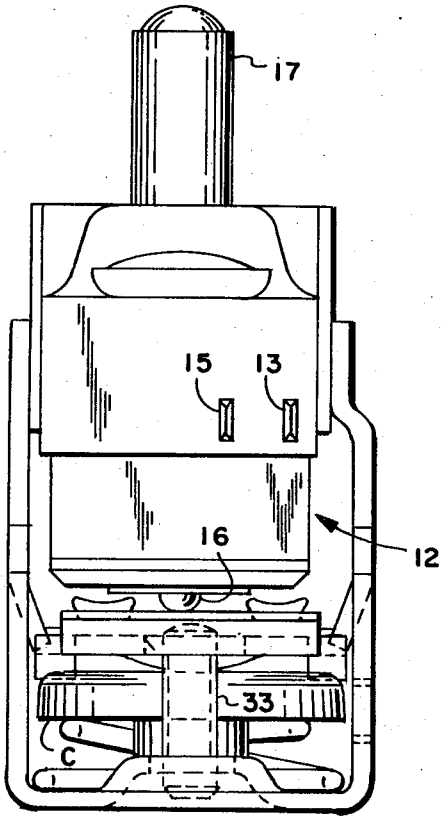
FIG. 2 is an end view taken from the left end of FIG. 1.

Referring to FIG. 1 and FIG. 2, a thermostat assembly indicated generally at 10 has a snap action switch assembly indicated generally at 12, mounted on a housing or frame 14. Switch 12 has a moveable actuator or plunger 16 for affecting actuation and deactuation of a set of electrical contacts (not shown) located within the switch 12, which are connected to electrical terminals 13, 15 extending externally for circuit connection thereto. If desired, the switch 12 may have a manually actuated reset plunger such as that shown at 17.

The housing 14 has provided thereon a stationary fulcrum 18. A lever member 20 is pivoted about fulcrum 18 adjacent an end thereof, and is biased against the fulcrum by a preferably conical spring 22 contacting the lever 20 adjacent the right end thereof in FIG. 1. The opposite end of the lever 20 has a flange portion 23 formed at right angles to the longitundinal direction of the lever 20. The flange portion has mounted thereon, one end of a generally U-shaped beam spring member 24, which extends longitudinally of the lever member and generally parallel thereto in cantilever arrangement. Beam spring 24 preferably formed of bimetal material has the free end thereof self-biased against an adjustable stop in the form of a set screw 26 threaded through the end of lever 20 in the region contacted by the spring 22. The set screw 26 positions the rightward end of the beam spring with respect to the lever 20. The face of the beam spring 24 intermediate the ends is disposed to contact the switch actuator 16 upon movement of the lever 20 about fulcrum 18.

A fluid filled pressure capsule indicated by the reference character "C" in FIG. 1 is disposed on the housing and has a flexible diaphragm portion thereof 28 disposed to contact a portion of the lever 20 intermediate the fulcrum 18 and flanged end 23. In the present practice of the invention, the lever has a raised or dimpled portion 30 provided thereon for precisely locating the point of contact of diaphragm 28 with the lever. The fluid filled capsule "C" has connected thereto a fluid capillary 32 which receives fluid under pressure from a suitable temperature sensing bulb (not shown) in a manner well known in the art. The diaphragm portion 28 of the liquid filled capsule "C" expands upon the bulb sensing increasing temperature such that the diaphragm 28 pivots lever 20 in a counterclockwise direction about fulcrum 18 causing the beam spring 24 to actuate the switch 12, via the switch actuation plunger 16.

A stationary adjustable stop in the form of a set screw 33 is threaded through a recess 34 provided in the housing 14. Set screw 33 passes through a clearance aperture 36 provided in the lever; and srew 33 has the end thereof disposed to be spaced closely adjacent the beam spring 24 in the normal operating state of the thermostat 10. Set screw 33 is adjusted upon calibration such that during normal actuation and deactuation of the switch in the range of temperatures for which it is desired to provide control actuation of the switch 12, the set screw 33 does not make contact with beam spring 24.

Figure 3A:
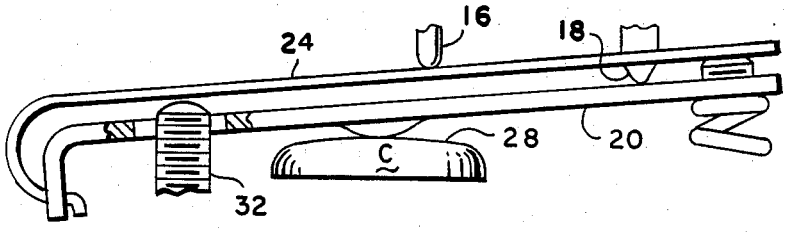
FIG. 3A is a schematic of the lever mechanism of FIG. 1 in a position prior to switch actuation.

Referring now to FIG. 3A, the lever mechanism is shown in the position corresponding to capsule "C" being pressurized through capillary 32 while the bulb is sensing increasing temperature, but prior to switch actuation. In the position shown in FIG. 3A, the beam spring 24 makes contact with the switch plunger 16 and causes upward motion of the plunger 16, but, by an amount insufficient to effect actuation of the switch 12.

Figure 3B:
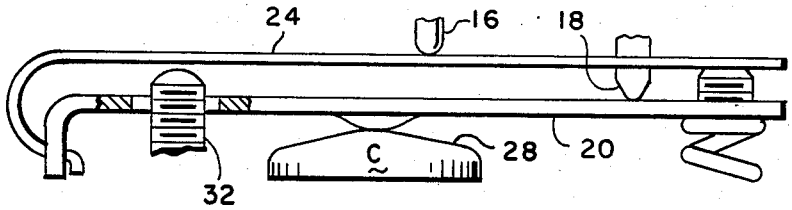
FIG. 3B is a schematic of the lever mechanism of FIG. 1 with the lever in the switch actuated position; and, FIG. 3C is a schematic of the lever mechanism of FIG. 1 in the emergency which actuated position after loss of fluid in the capsule.

Referring to FIG. 3B, the lever mechanism is shown in the position, wherein the capsule "C" has responded to capillary fluid pressure corresponding to a sensed temperature sufficient to cause diaphragm 28 to raise lever 20 and beam spring 24 thereby raising plunger 16 to a position causing actuation of the switch 12. It will be understood that in the positions shown in FIGS. 3A and 3B, the lever mechanism is pivoted about the stationary fulcrum 18.

Figure 3C:
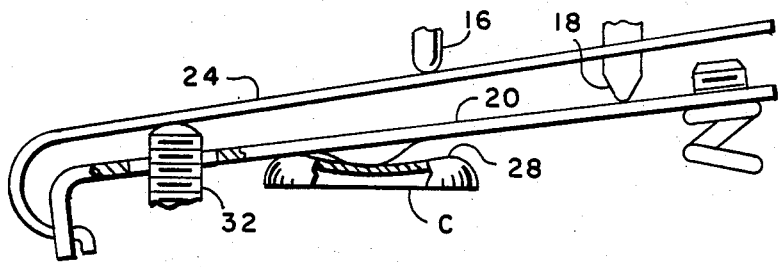

Referring to FIG. 3C, the lever mechanism 20 is shown in the position wherein capsule "C" has suffered a loss of liquid fill, and the lever 20 has been biased by conical spring 22 in a counterclockwise direction about fulcrum 18 until the beam spring 24 contacts the tip of the set screw 33 and under the bias of conical spring 22, set screw 33 deflects the beam spring 24 in the manner of cantilever deflection with respect to lever 20 about the end of the beam spring 24 anchored to flange 23, in a counterclockwise direction, thereby causing switch actuation.

The present invention has the unique feature that the switch actuation may be calibrated readily in a simulated loss of fluid in the capsule condition without breaching the integrity of the fluid filled capillary and capsule. In the present practice it has been found particularly expedient to immerse the sensing bulb and portions of capillary 32 adjacent thereto in a sub-cooled fluid such as ethylene glycol at 15° F. (−9° C.) thereby effecting contraction of the fluid in the capsule and lowering the diaphragm 28 to thereby simulate the position of the diaphragm 28 in the condition when fluid fill has been lost. With diaphragm 28 in the contracted position, the adjustment screw 33 may be rotated until the end thereof contacts beam spring 24 and causes switch plunger 16 to be moved to effect actuation of switch 12. The screw 33 is then left in this position. Upon removal of the sensing bulb and capillary from the sub-cooled liquid, the diaphragm returns the lever 20 to the normal position for switch actuation responsive to rising temperature of the fluid fill in the bulb, and pressure rise in capsule C.

It will be understood that actuation of switch 12 by beam spring 24 contacting stationary set screw 33 may be employed as an emergency signal input to the control system to provide system lockup or as a failure input to a micro-computer controller for effecting system shutdown.

Although the invention has hereinabove been described and illustrated with respect to the presently preferred practice, it will be understood that the invention is capable of variation and modification therefrom, and is intended as limited only by the following claims.

I claim:

1. A thermostatically operated switch assembly comprising:

(a) housing means;

(b) a switch mechanism mounted on said housing means having a pair of electrical contacts at least one of which is moveable for making and breaking a circuit therebetween;

(c) an actuator member moveable with respect to said housing means and operable upon movement to effect actuation and deactuation of said switch mechanism;

(d) a thermally expansible fluid pressure operated capsule mounted on said housing means;

(e) a lever mounted for pivotal movement about a fulcrum on said housing means;

(f) means biasing said lever into contact with said expansible capsule;

(g) a spring member attached to said lever means and adjustable with respect thereto for calibrating contact of said spring member with said actuator member upon movement of said lever by said capsule;

(h) stop means mounted on said housing means, said stop means being disposed to cause said spring member to be deflected with respect to said lever in the event of loss of fluid in said capsule for effecting actuation of said switch mechanism.

2. The switch assembly defined in claim 1, wherein said stop means is adjustable for facilitating calibration thereof in a simulated lost fluid condition.

3. The switch assembly defined in claim 1, wherein said spring member is formed at least in part of bimetal material for ambient temperature compensation of calibration.

4. A thermostatic switch assembly comprising:

(a) housing means;

(b) a switch mounted on said housing means operable for making and breaking a circuit upon switch actuation and deactuation;

(c) an actuator member moveable with respect to said housing means and operable upon movement to effect said actuation and deactuation of said switch;

(d) lever means mounted for pivotal movement about a first fulcrum on said housing means, said lever means including resilient means defining a contact surface adjustably calibrated with respect to said actuator member and operable upon movement of said lever means for contacting said actuator member and effecting said movement thereof;

(e) a thermally expansible fluid pressure operated capsule mounted on said housing means and operable to move said lever means in response to sensed temperature changes;

(f) means biasing said lever means about said first fulcrum in a direction causing said lever means to contact said expansible capsule; and (g) stop means mounted on said housing means spaced from said first fulcrum and disposed to contact said resilient means in the event said capsule is subject to loss of fluid whereupon said resilient means is pivoted about said stop means and is operable to actuate said switch.

5. The switch assembly defined in claim 4, wherein said stop means is adjustable for facilitating calibration thereof in a simulated lost fluid condition.

6. The switch assembly defined in claim 4, wherein said resilient means includes a bimetal member operable to provide ambient temperature compensation to said actuator calibration.

7. The switch assembly defined in claim 4, wherein said switch includes a snap-acting mechanism.

8. A method of calibrating a fluid filled capsule type thermostat for emergency switch actuation in the event of loss of fluid in the capsule:

(a) disposing a pivoted lever mechanism adjacent said capsule for movement thereby;

(b) cantilevering a spring from said lever mechanism;

(c) positioning a switch adjacent said spring for actuation thereby;

(d) disposing a stop adjacent said spring;

(e) sub-cooling the liquid fill in said capsule for simulating the loss of fluid condition of said capsule;

(f) maintaining said sub-cooling and adjusting said stop to effect actuation of said switch; and (g) terminating said sub-cooling.

9. A method defined in claim 8 wherein the step of sub-cooling comprises immersing said bulb in a liquid bath maintained at about 15° F. (−9° C.).

* * * * *